US008578871B2

(12) United States Patent
Smith et al.

(10) Patent No.: US 8,578,871 B2
(45) Date of Patent: Nov. 12, 2013

(54) AUTOMATED FLANGING MACHINE

(75) Inventors: Jay Mark Smith, Carthage, MO (US); Dustin W. Smith, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 316 days.

(21) Appl. No.: 13/037,628

(22) Filed: Mar. 1, 2011

(65) Prior Publication Data

US 2012/0222603 A1 Sep. 6, 2012

(51) Int. Cl.
*D05B 21/00* (2006.01)

(52) U.S. Cl.
USPC ..... 112/475.07; 112/309

(58) Field of Classification Search
USPC ..... 112/470.03, 470.04, 470.05, 150, 153, 112/470.12, 470.18, 306, 309, 2.1
See application file for complete search history.

(56) References Cited

U.S. PATENT DOCUMENTS 5,396,854 A * 3/1995 Noqueras ..... 112/470.18
5,520,129 A * 5/1996 Porter et al. ..... 112/470.07
5,529,004 A * 6/1996 Porter et al. ..... 112/470.03
5,908,004 A 6/1999 Porter et al.
6,000,352 A 12/1999 Porter et al.
6,082,277 A * 7/2000 Block et al. ..... 112/2.1
7,047,895 B2 5/2006 Block et al.

OTHER PUBLICATIONS

PCT/US2012/026903 International Search Report and Written Opinion, dated Jun. 7, 2012, 13 pages.

* cited by examiner

*Primary Examiner* — Danny Worrell
(74) *Attorney, Agent, or Firm* — Shook, Hardy & Bacon L.L.P.

(57) ABSTRACT

An automated flanging machine is provided. More specifically, a machine for automatically sewing a flange onto a work panel having a consistent corner radius and a straight edge is provided. The machine has a table adapted to support a work panel, a sewing head mounted directly adjacent to the table for performing a sewing operation on the work panel, a turning arm mounted adjacent to the table, and a rear conveyor for selectively moving the work panel on the table. The table may include a corner pivot mechanism for stabilizing the panel while the turning arm turns the panel 90 degree relative to an initial position, and for maintaining a consistent corner radius for sewing. The machine may also include a rear material guide and encoding arm for measuring the progression of the work panel as it is sewn along a side by the sewing head.

18 Claims, 17 Drawing Sheets

AUTOMATED FLANGING MACHINE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to automated sewing machinery. More particularly, the invention relates to an automated flanging machine for sewing a flange onto a work panel having a consistent corner radius and a straight edge.

BACKGROUND OF THE INVENTION

The sewing of large panels of material often involves manual manipulation by an operator. For example, when sewing a flange onto bedding panels having a predetermined size and straight edges, a high level of skill and attention is required by the operator during sewing and manipulation of the panel along each side. To reduce the amount of operator attention required during sewing, some panels are sewn using automated methods.

One problem with automated sewing machinery is ensuring that panels may be automatically sewn with a consistent corner radius and straight edges. For example, some automated sewing machines follow the cut edge of a work panel, and therefore do not automatically produce straight sewn edges when the sides of a panel are not cut along a straight line. Further, if the automatic turning of a work panel is not accurate, the finished work panel may be sewn with varying corner angles, creating a trapezoid-shaped panel. In addition to straight edges and consistent corner turns, it is also important that a panel may be manipulated and turned during sewing with minimal operator intervention.

Accordingly, a need exists for an automated flanging system that automatically sews a flange onto panels having a consistent corner radius and straight edges, with minimal operator intervention, which addresses the foregoing and other problems.

BRIEF SUMMARY OF THE INVENTION

The present invention generally relates to an automated flanging machine that requires minimal operator intervention and sews work panels having a consistent corner radius and straight edges. Throughout the remainder of this application, reference will be made to a "work panel." It should be understood that the invention contemplates sewing flanges onto all types of panels made of a variety of materials, both bedding and otherwise, and that the invention is not limited to the specific component being operated on. The automated flanging machine has a table with a table surface that supports a work panel during sewing. In one embodiment, an operator loads a work panel on the table surface and enters identifying information associated with the work panel into an operator interface associated with the machine.

The table includes a sewing head mounted directly adjacent to the table for performing a sewing operation on the work panel. The operator may actuate a foot pedal that lifts the presser foot of the sewing head while the work panel is loaded onto the machine. After positioning of the work panel onto the table, the machine then automatically sews a flange onto the straight edges of the work panel, creating straight sewn sides and corners with a consistently-sewn radius. In some embodiments, the machine may be used to sew the straight edges and consistent corners of the work panel, without attaching a flange to the bottom of the work panel.

To selectively turn the work panel on the table surface, the automated flanging machine utilizes a turning arm mounted adjacent to the table. In embodiments, the turning arm is engaged against a work panel during turning of the work panel (and sewing of the corner radius), and is not in contact with the work panel during sewing of the sides of the work panel. In further embodiments, a corner pivot mechanism is engaged against the corner of the work panel during turning of the work panel on the table surface. Additionally, the corner pivot mechanism maintains a consistent corner radius while the corner is sewn by the machine.

A rear conveyor, having a conveyor belt and a conveyor pressure skid, is mounted adjacent to the table. The conveyor belt advances the work panel along the table surface. In embodiments, the conveyor pressure skid is engaged against the work panel during sewing of the straight sides of the work panel, and is not in contact with the work panel while the work panel is being turned (and the corners are being sewn). A material guide and encoding arm is utilized to measure the progression of the work panel as it is sewn by the sewing head. In embodiments, the material guide and encoding arm is engaged against the edge of the work panel during sewing of the straight edges of the work panel, and is not in contact with the work panel during turning of the work panel. The machine also includes a flange knife assembly that cuts the flange once sewing of the work panel is completed.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
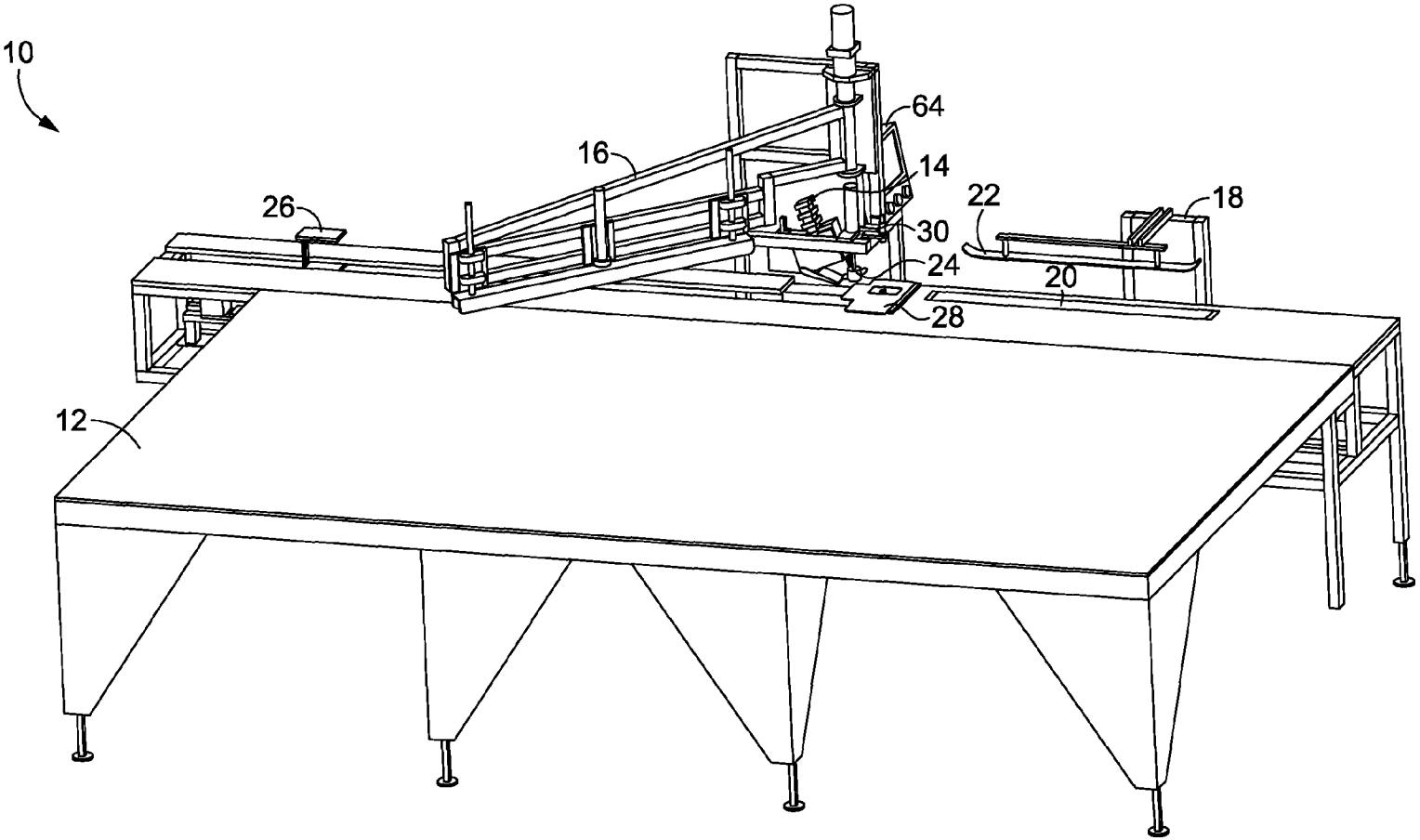
FIG. 1 is a perspective view of one embodiment of the automated flanging machine.

An embodiment of an automated flanging machine 10 is seen in FIGS. 1-17. Referring first to FIG. 1, automated flanging machine 10 includes a table surface 12, a sewing head 14, a turning arm 16, a rear conveyor 18, a conveyor belt 20, a conveyor pressure skid 22, a corner pivot mechanism 24, a material guide and encoding arm 26, a flange knife assembly 28, a trailing edge sensor 30, and an operator interface 64. In some embodiments, the height of the machine 10 may be adjusted by an operator of the machine 10, such that the table surface 12 reaches the operator's optimal standing working height. Further, although not depicted in FIG. 1, the sewing head 14 may be associated with a foot pedal that the operator may use to raise and/or lower a presser foot of the sewing head 14.

The rear conveyor 18 includes the conveyor belt 20 and the conveyor pressure skid 22, which will be discussed later with reference to FIG. 15. The rear conveyor 18 selectively moves a work panel on the table surface 12, such as work panel 32 depicted in FIG. 2. As such, the conveyor belt 20 and conveyor pressure skid 22 are engaged against the work panel 32 during sewing of a straight side of the work panel 32, and are disengaged from the work panel 32 during turning of the work panel 32 (and sewing of the corner radius). In embodiments, the conveyor belt 20 of the rear conveyor 18 moves in the same direction and at the same rate as the sewing head 14, in order to advance a work panel along the table surface 12 at a consistent speed.

As will be discussed in more detail with reference to FIG. 17, the material guide and encoding arm 26 follows the edge of a work panel 32 as it is sewn by the machine 10, and moved along the table surface 12. In following the edge of the work panel 32, the material guide and encoding arm 26 measures the distance sewn along the straight edges of the work panel 32, which allows the machine 10 to determine when the work panel 32 is ready to be turned.

The turning arm 16 is capable of selectively engaging against a work panel 32. During turning and sewing of the corner radius of the work panel 32, the turning arm 16 is engaged against the work panel 32, and is not in contact with the work panel during sewing along the straight sides of the work panel 32. Similarly, the corner pivot mechanism 24 is engaged against the corner of a work panel during turning (and sewing of the corner radius), and is not in contact with the work panel during sewing (along the straight sides of the work panel 32) by the sewing head 14.

Figure 2:
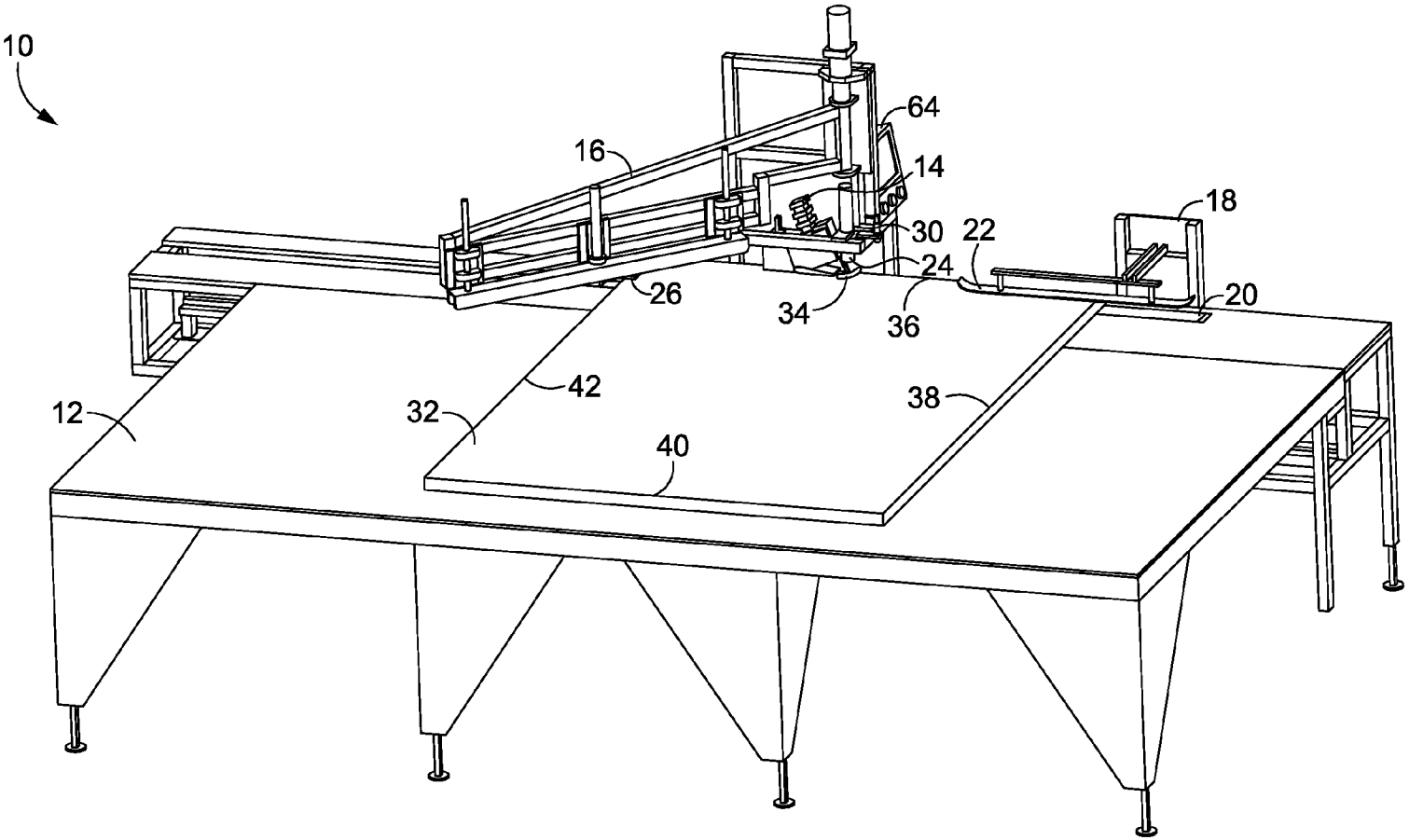
FIGS. 2-14 are perspective views of the machine of FIG. 1, with a work panel loaded onto the table surface.

As shown in FIG. 2, a work panel 32 may be loaded on to the table surface 12 of the machine 10 for automatic sewing of a flange by the sewing head 14. The work panel 32 has a first side 36, a second side 38, a third side 40, and a fourth side 42. In embodiments, the machine 10 is used to sew together two or more layers of material making the work panel 32, or "close" the material of a work panel 32 together. For example, when the operator loads the work panel 32 onto the machine 10, the edges may be "open" (i.e. not sewn together). In some embodiments, the work panel 32 is constructed of a bottom sheet of fabric, several middle layers of various types of foam and fiber fill, and top sheet of fabric. Prior to loading the work panel 32 onto the machine 10, these layers of materials may be quilted on a quilting machine, with the work panel 32 being cut on its edges to the rough size of the finished work panel 32. The machine 10 may then used to both close the edges of the work panel 32 and, at the same time, attach a flange to the bottom side of the work panel 32. In further embodiments, the machine 10 is only used to close the edges of the work panel 32, and does not attach a flange to the closed edge of the work panel 32. In both embodiments (either closing the edges of the work panel 32 and attaching a flange, or simply closing the edges of the work panel 32 without attaching a flange), the machine 10 is used to produce a finished work panel 32 with sewn straight edges and corners sewn with a consistent corner radius, while measuring the work panel 32 in length and width. As such, sewing a work panel 32 with straight edges and consistent corners while measuring length and width produces a work panel 32 that is finished to the required dimensions.

Having loaded the work panel 32 onto the table surface 12, an operator may enter identifying information related to the work panel 32 into the operator interface 64. For example, the operator may select a pre-loaded SKU number (a "stock-keeping unit" number) from the operator interface 64. Alternatively, the operator may input a new SKU number into the operator interface 64, which identifies the work panel 32. Such identifying information input by the operator may include the total size of the work panel 32, the length of the straight sides of the work panel 32, the corner radius to be sewn on the corners of the work panel 32, and the like.

When preparing the work panel 32 for sewing by the machine 10, the operator may actuate a foot pedal to raise and/or lower the presser foot 34 of the sewing head 14. In doing so, a flange will be fed through the flange knife assembly 28 and underneath the presser foot 34 of the sewing head 14. In embodiments, the presser foot 34 may be raised to varying heights to allow an operator to load various thicknesses of work panels 32 onto the machine 10.

In one embodiment, the presser foot 34 may be raised up to 1.5 inches from the table surface 12 to allow for loading of a heavier-weighted work panel 32. In preparing the work panel 32 for sewing by the machine 10, in some embodiments, the operator uses a laser line generator to project a laser line onto the work panel 32 so that the operator can align the work panel 32 on the table surface 12 of the machine 10. For example, the operator may align certain features within the quilted pattern of the work panel 32 with the laser line, thus allowing the work panel 32 to be cut and sewn in along a line that is parallel to the features of the work panel 32.

Having confirmed that the work panel 32 is loaded correctly onto the table surface 12 of the machine 10, the operator may engage the rear conveyor 18 by selection of an option from the operator interface 64. In doing so, the conveyor belt 20 will engage against the bottom surface of the work panel 32, and the conveyor pressure skid 22 will engage against the top surface of the work panel 32, thereby securing the work panel 32 for movement. In embodiments, the conveyor belt 20 and conveyor pressure skid 22 secure the work panel 32 with minimal pressure between the two parts of the rear conveyor 18. A foot pedal associated with the sewing head 14 may then be released and the presser foot 34 of the sewing head 14 may engage against the work panel 32 for the machine 10 to begin automatically sewing a flange around the perimeter of the work panel 32.

As previously discussed, the conveyor belt 20 and the presser foot 34 of the sewing head 14 move at a consistent pace to advance the work panel 32 during sewing. During sewing, the material guide and encoding arm 26 may then engage against the rear edge of the work panel 32. In embodiments, the material guide and encoding arm 26 clamps the edge of the work panel 32, such as clamping the fourth side 42 of the work panel 32 depicted in FIG. 2. In doing so, the material guide and encoding arm 26 follows the edge of the work panel 32 while the first side 36 of the work panel 32 is sewn by the sewing head 14. In embodiments, a linear encoder in the material guide and encoding arm 26 is used to measure the distance sewn by the sewing head 14 along the straight sides of the work panel 32.

Figure 3:
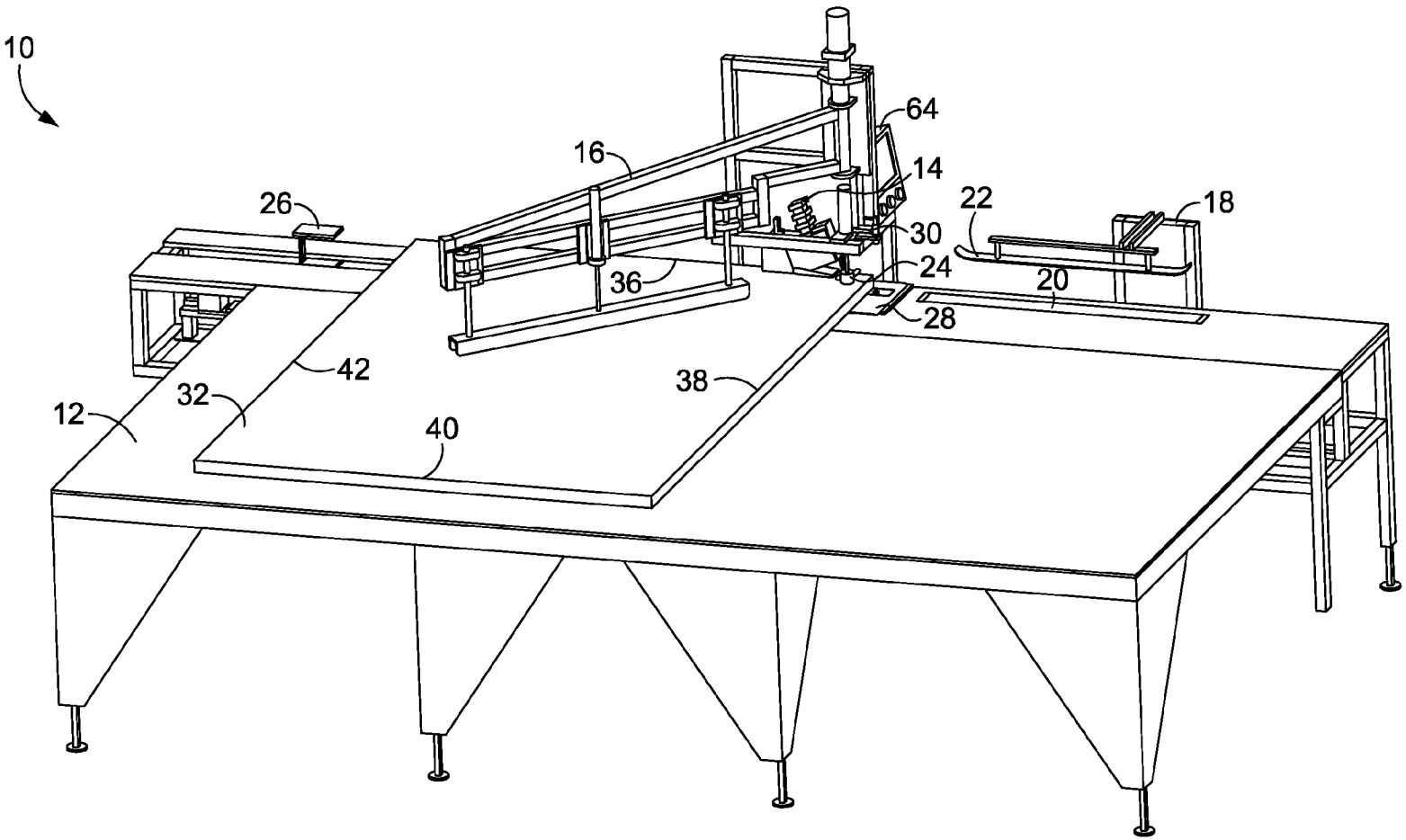

Turning next to FIG. 3, as the trailing edge of the first side 36 of the work panel 32 approaches the sewing head 14, the trailing edge sensor 30 detects that the machine 10 has completed sewing at least a portion of the first side 36 of the work panel 32. Having sensed the trailing edge of the first side 36, the trailing edge sensor 30 indicates to the machine 30 that the work panel 32 is ready to be turned, and the corner radius is ready to be sewn. As shown in FIG. 3, in order to turn the work panel 32, the turning arm 16 and the corner pivot mechanism 24 engage against the work panel 32. Engaging the corner pivot mechanism 24 against the work panel 32 provides a pivot point around which the machine 10 can sew a consistent corner radius. For example, when turning the work panel 32 from sewing the first side 36 to sewing the second side 38, the corner pivot mechanism 24 maintains a constant distance between the sewing head 14 and the edge of the work panel 32, thus ensuring that the machine 10 sews a consistent corner radius with the sewing head 14.

Also depicted in FIG. 3, the cylinders of the turning arm 16 actuate and engage the work panel 32 to turn the work panel 32 to a position that is 90 degrees relative to the initial position of the work panel 32. For example, the turning arm 16 turns the work panel 32 from sewing along the first side 36 to sewing along the second side 38. Once the turning arm 16 and the corner pivot mechanism 24 are engaged with the work panel 32, the material guide and encoding arm 26 and rear conveyor 18 disengage from the work panel 32 so that the turning arm can reposition the work panel 32.

Figure 4:
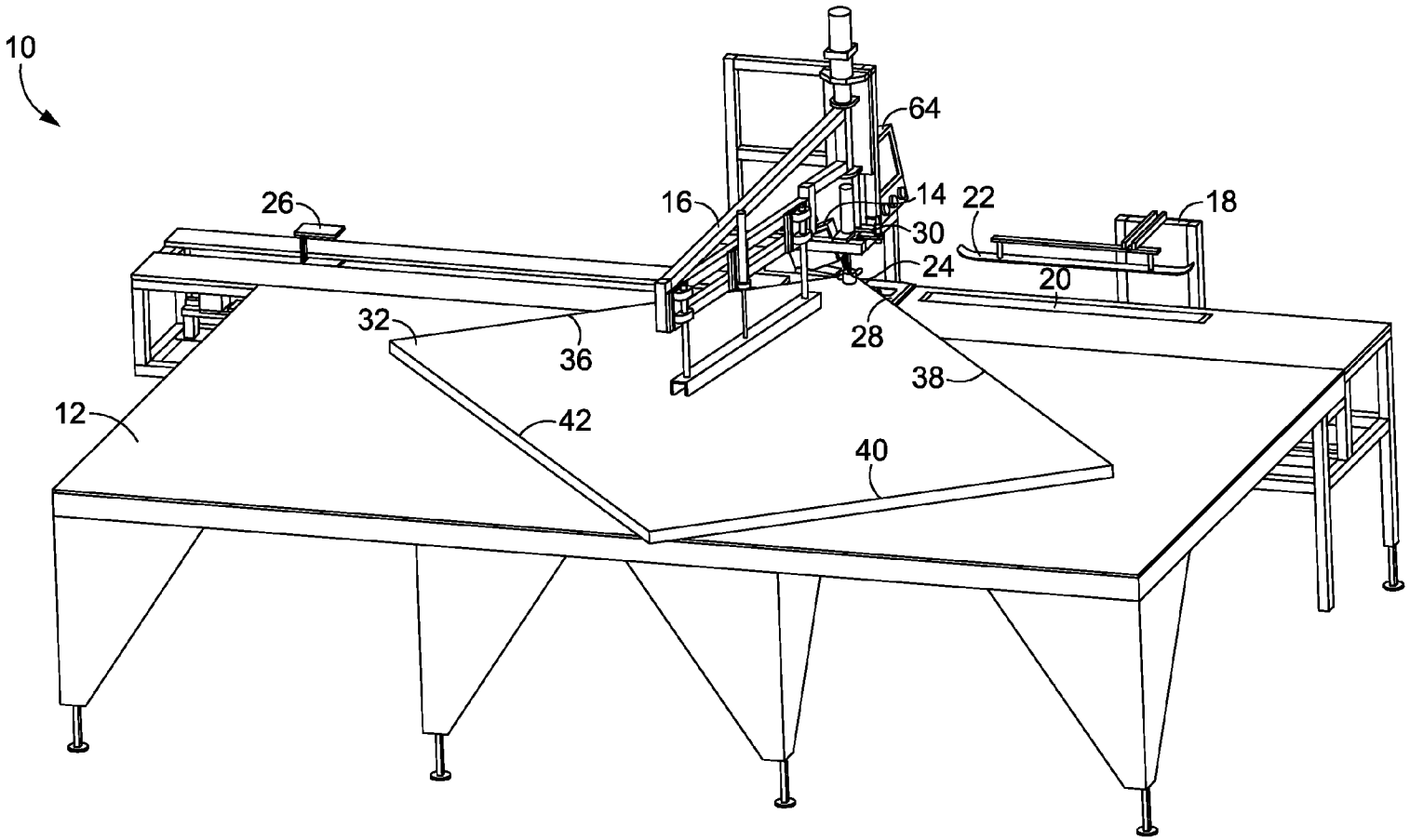

Referring next to FIG. 4, with the material guide and encoding arm 26 disengaged from against the work panel 32, the turning arm 16 rotates the work panel 32 to a position 90 degrees relative to the original line sewn along the first side 36, while continuing to sew the corner radius of the work panel 32 with the sewing head 14. During turning, the sewing head 14 sews a consistent corner radius between two sides of the work panel 32, such as the corner radius between the first side 36 and the second side 38. As such, the corner pivot mechanism 24 maintains a constant distance between the edge of the work panel 32 and the sewing head 14, which creates a consistently-sewn corner radius on the work panel 32.

Figure 5:
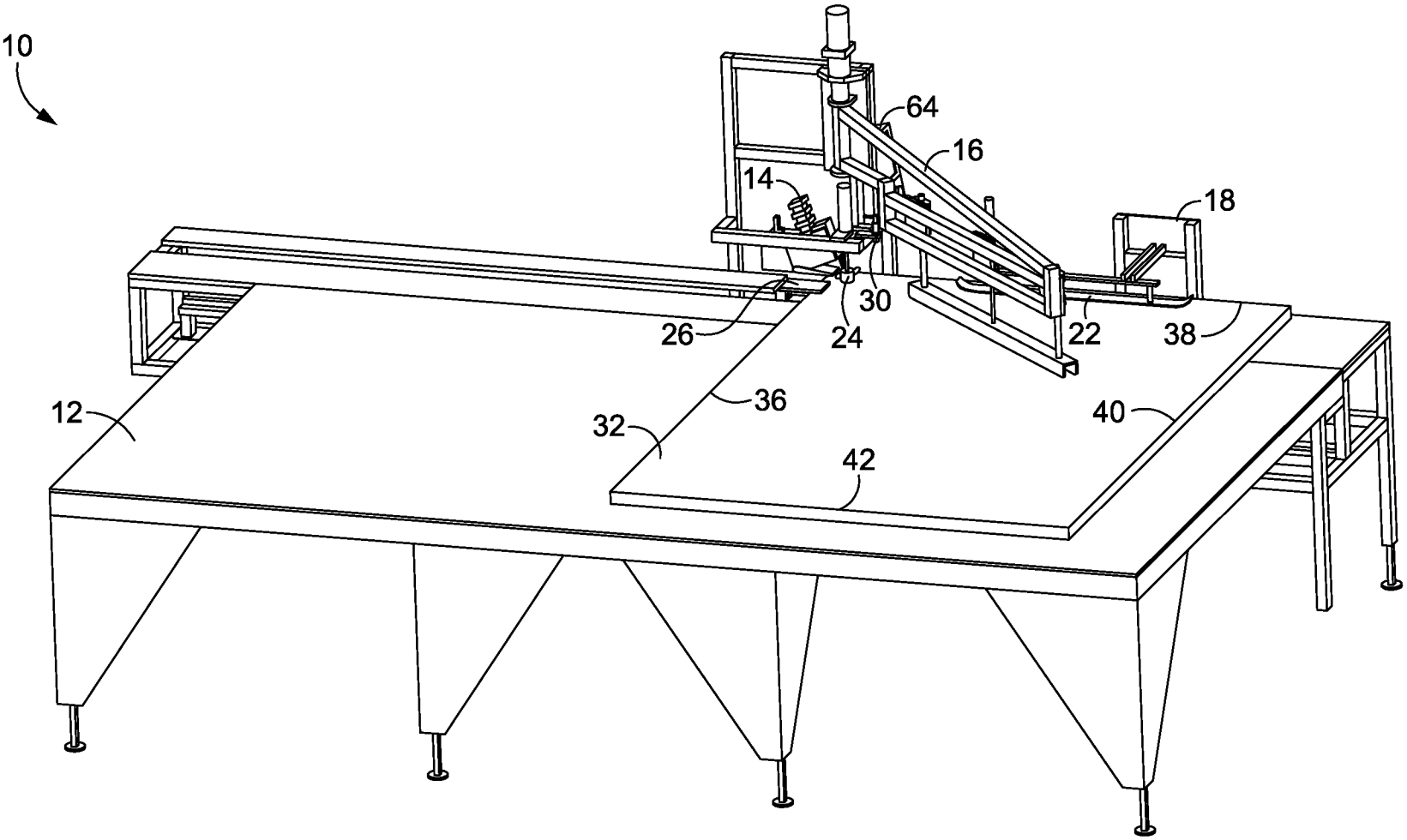
Figure 6:
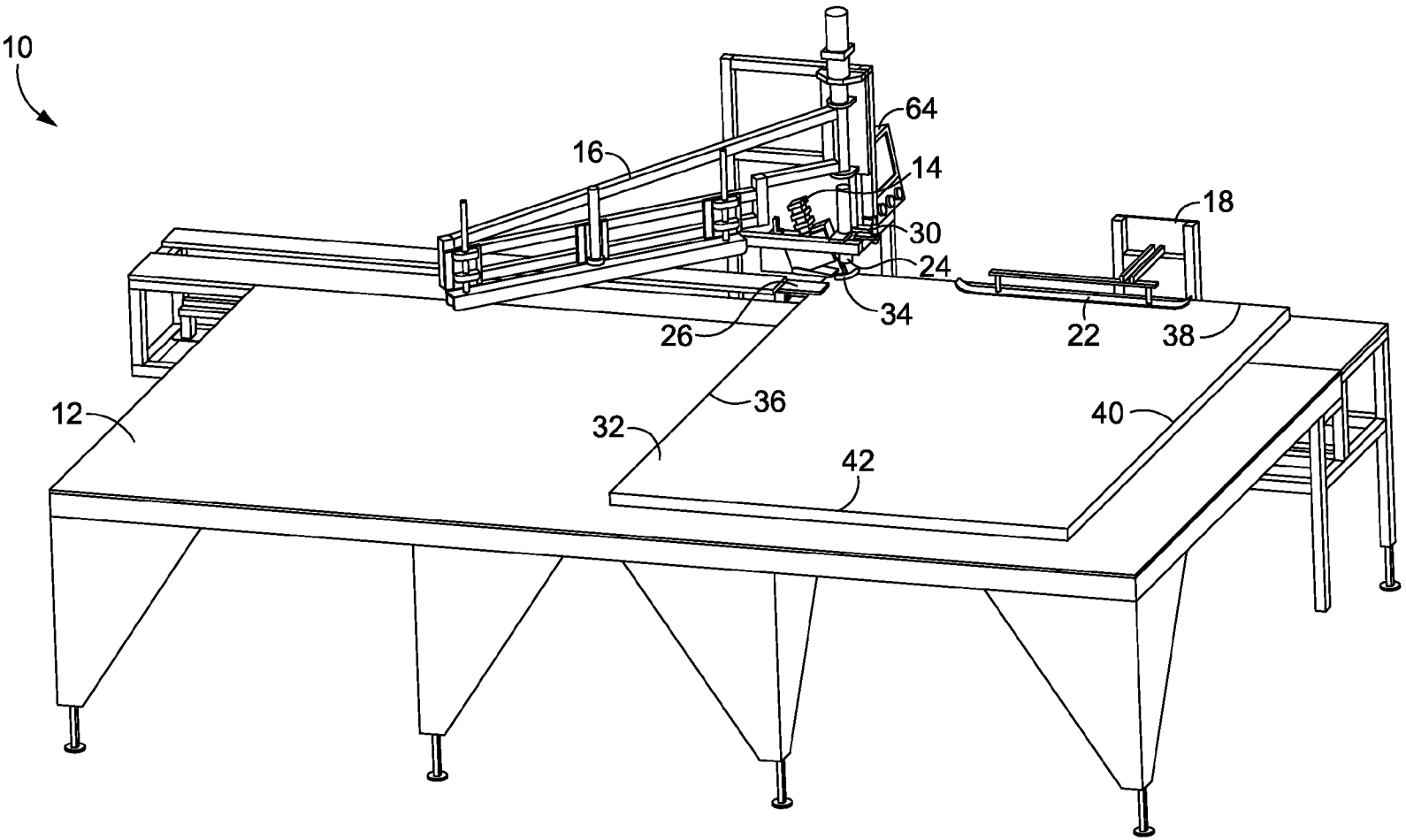

As shown in FIG. 5, the corner between the first side 36 and the second side 38 has been sewn. Prior to beginning sewing the second side 38, the rear conveyor 18 engages against the work panel 32. Further, the material guide and encoding arm 26 moves forward into contact with the work panel 32 and clamps the work panel 32 at the rear edge of the sewing head 14. Additionally, the cylinders of the turning arm 16 disengage and the turning arm 16 rotates back to its original position while the corner pivot mechanism also disengages from the surface of the work panel 32, as shown in FIG. 6. As further depicted in FIG. 6, the clamp of the material guide and encoding arm 26 is engaged against the first side 36 of the work panel 32, as the machine 10 prepares to sew the second side 38 of the work panel 32. The point at which the material guide and encoding arm 26 clamps the work panel 32 is a known distance from the needles of the sewing head 14 because the sewing head 14 has just completed sewing the corner radius between the first side 36 and the second side 38.

Figure 7:
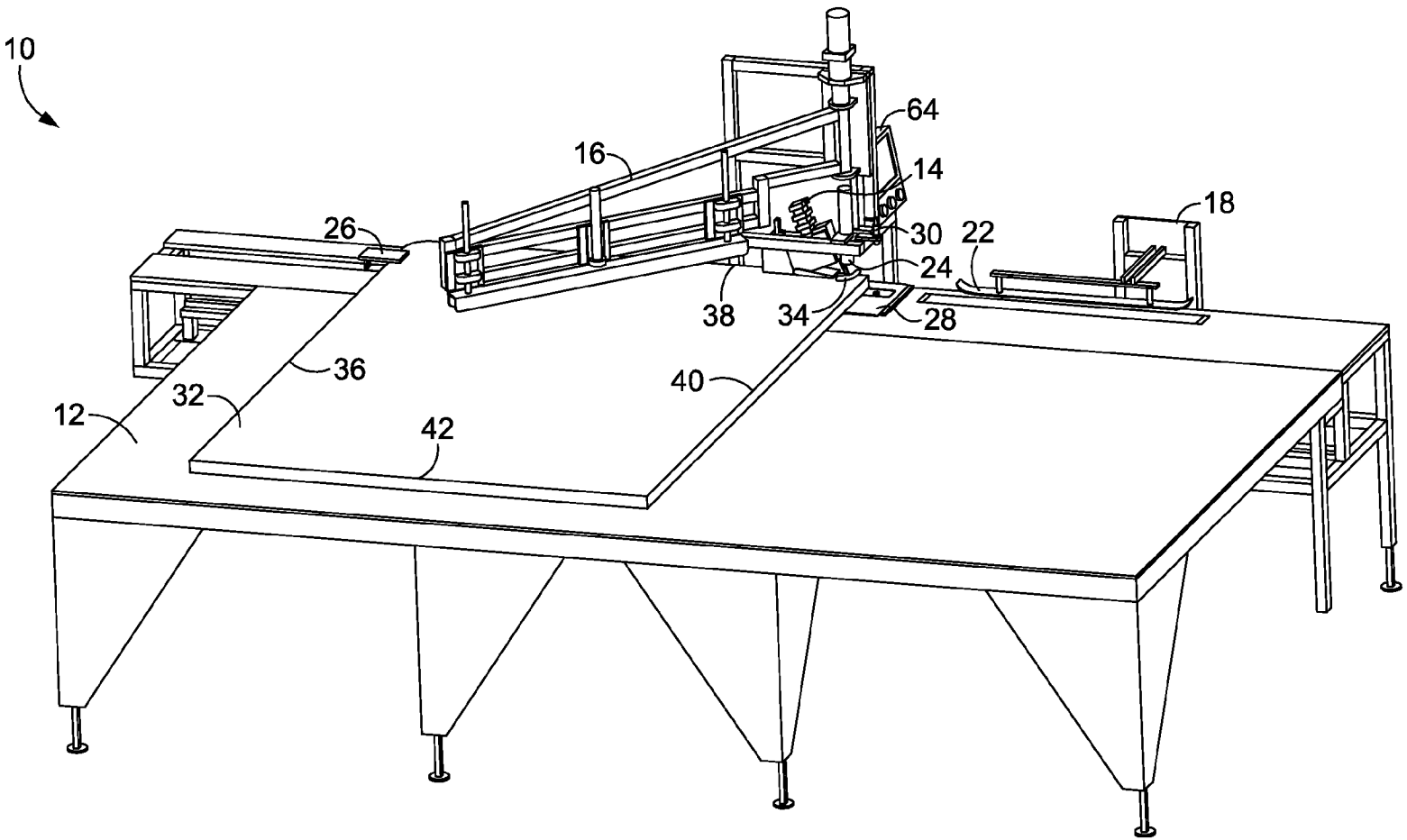

As the machine 10 begins sewing the second side 38 of the work panel 32, the material guide and encoding arm 26 begins measuring the distance that is sewn using a linear encoder, as shown in FIG. 7. When the distance sewn along the second side 38, added to the known distance where the work panel 32 is clamped by the material guide and encoding arm 26, equals the programmed length of the work panel minus the corner radius, the corner pivot mechanism 24 and the turning arm 16 engage to contact the work panel 32. For example, for a programmed work panel 32 having a total length of 20 inches and a corner radius sewn between the first side 36 and the second side 38 of 3 inches, the corner pivot mechanism 24 and the turning arm 16 will engage when the distance sewn along the second side 38 (as measured by the linear encoder of the material guide and encoding arm 26) added to the known distance where the work panel is clamped by the material guide and encoding arm, is equal to 17 inches.

Figure 8:
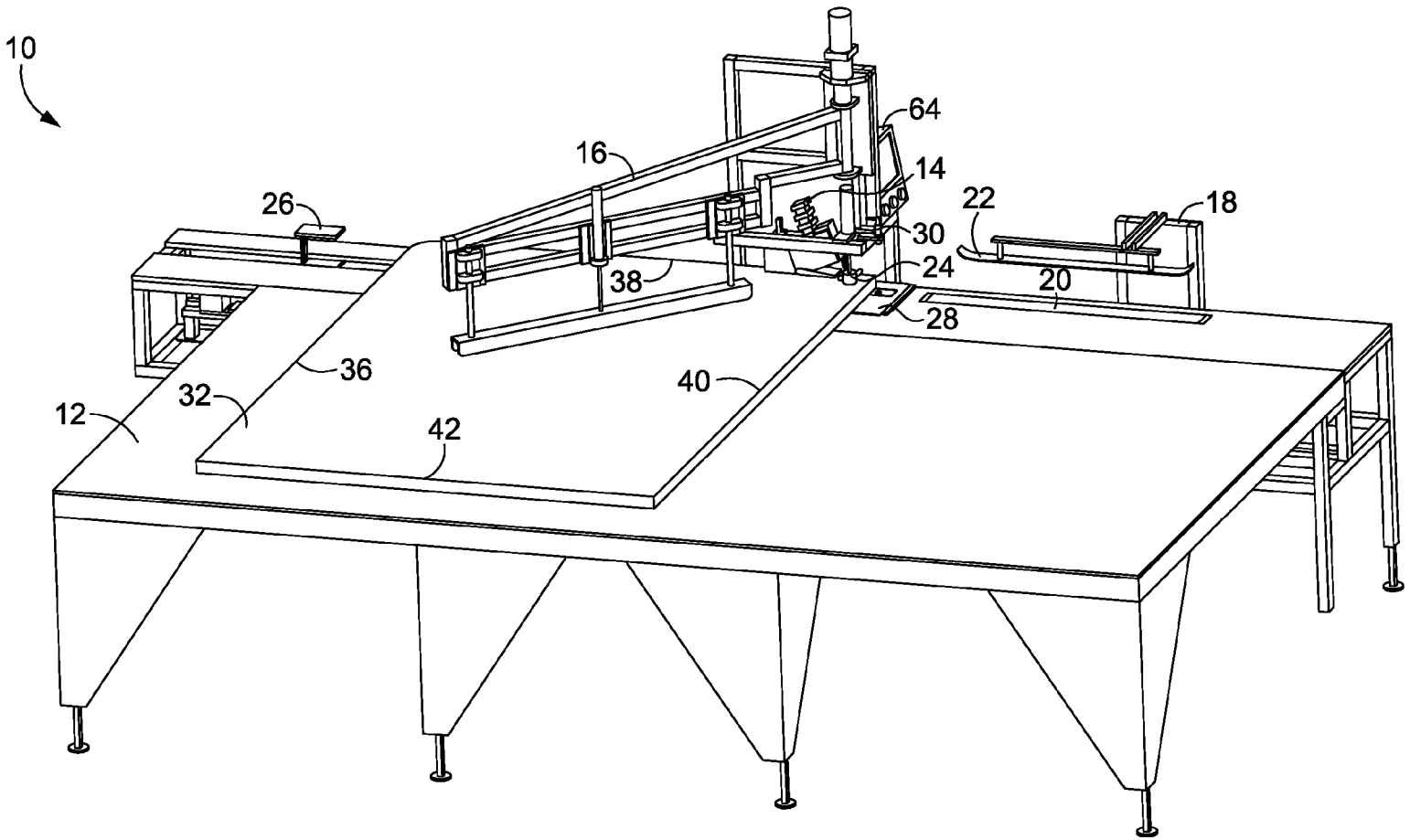
Figure 9:
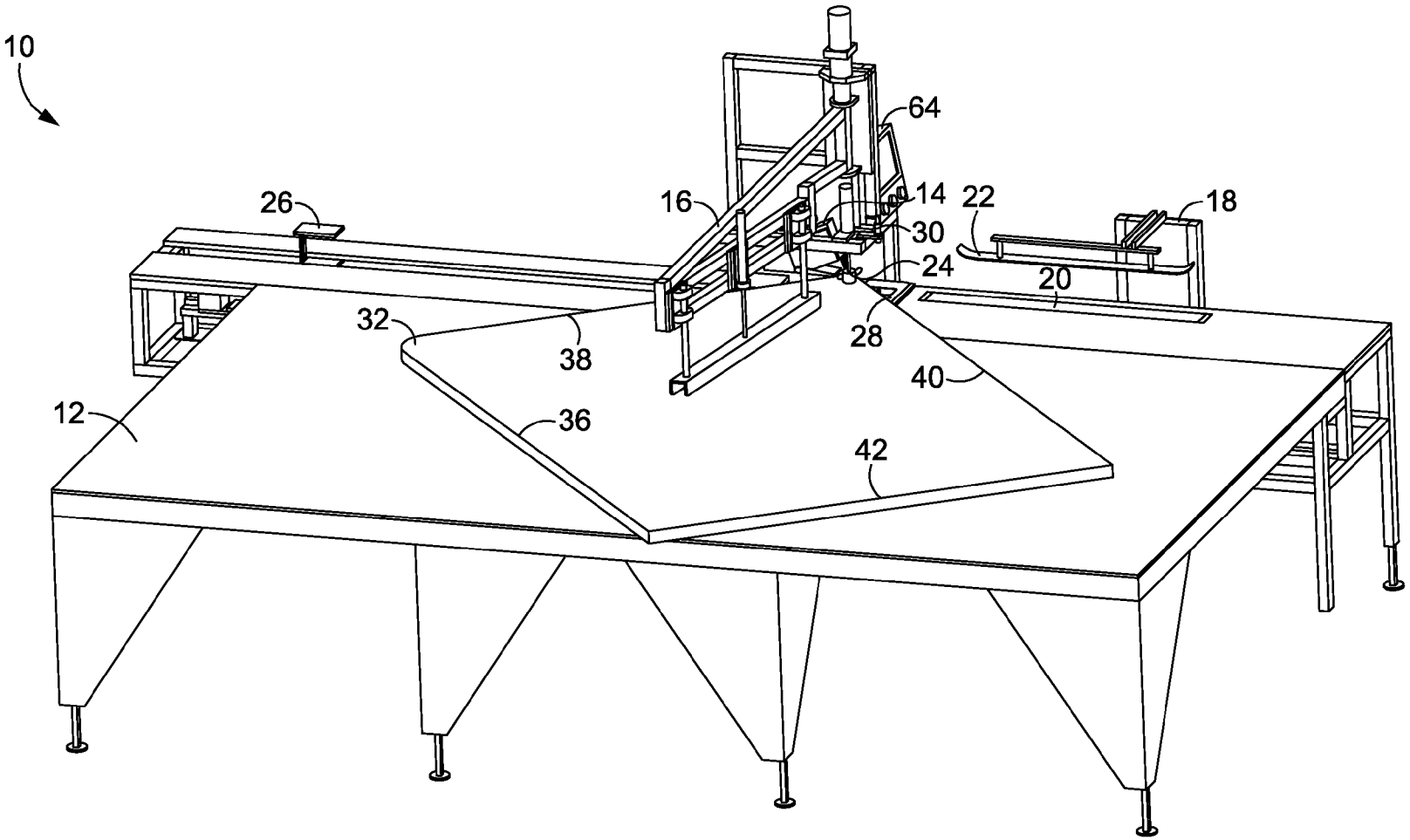

As shown in FIG. 8, the known distance (the point at which the material guide and encoding arm 26 is clamped to the work panel 32) added to the distance measured by the material guide and encoding arm 26 during sewing of the second side 38 of the work panel 32, equals the programmed length of the work panel 32 minus the corner radius. As such, the work panel 32 is ready to be turned for sewing of the corner between the second side 38 and the third side 40, as well as the sewing of the third side 40. As shown in FIG. 9, the clamp of the material guide and encoding arm 26 is disengaged from the edge of the work panel 32 and the corner pivot mechanism 24 and turning arm 16 engages against the work panel 32. The rear conveyor 18 is also disengaged from the work panel 32 during turning. The turning of the work panel around the corner between the second side 38 and the third side 40 is depicted in FIG. 9. As such, the same corner radius sewn between the first and second sides 36 and 38 is sewn between the second and third sides 38 and 40.

Figure 10:
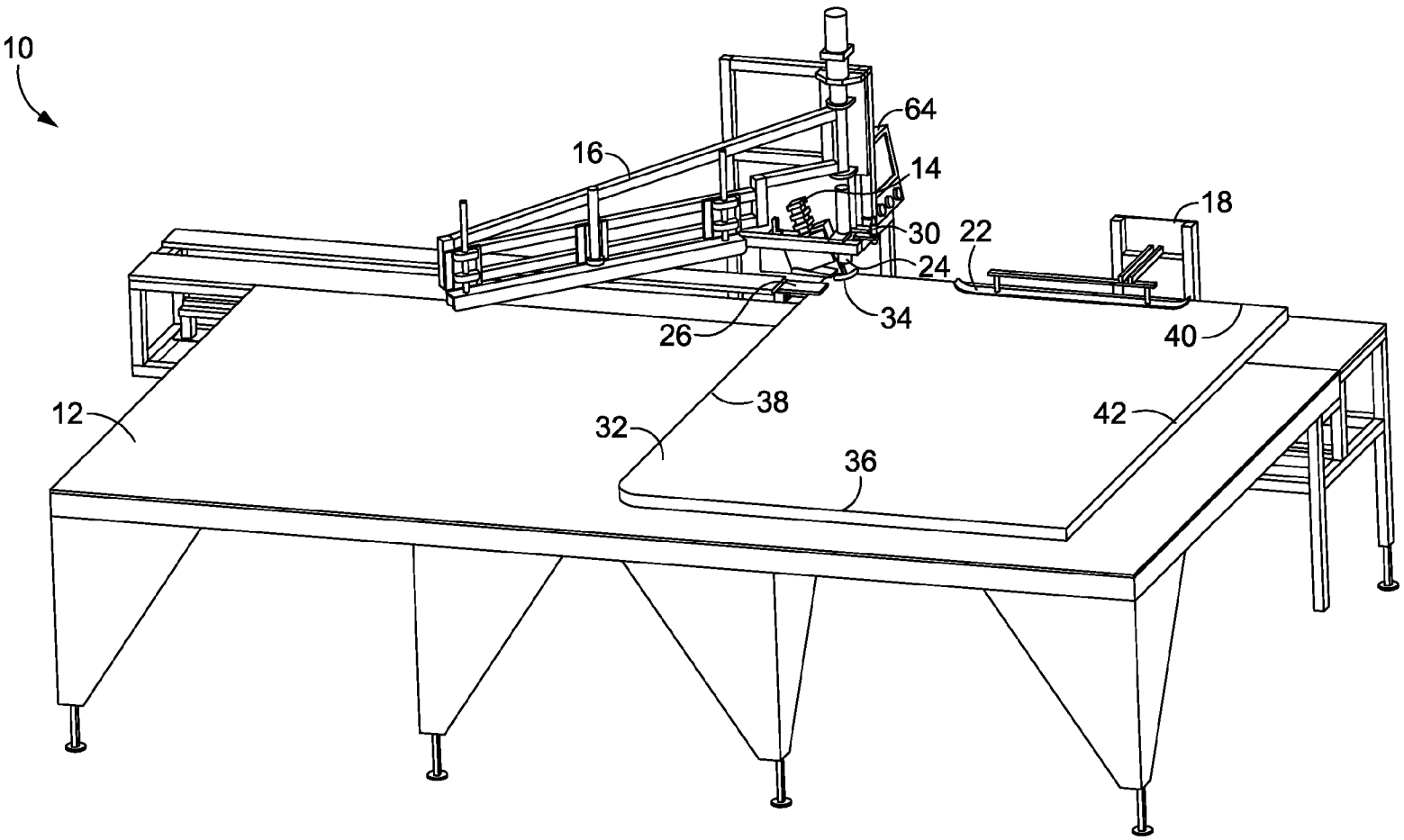

In FIG. 10, having completed sewing the second corner of the work panel 32, the machine 10 is prepared to sew the third side 40 of the work panel 32. As previously discussed, in preparation for sewing the third side 40, the clamp of the material guide and encoding arm 26, the conveyor pressure skid 22, and conveyor belt 20, are engaged against the work panel 32. Further, the turning arm 16 and corner pivot mechanism 24 are disengaged from the work panel 32. The third side 40 and the corner between the third side 40 and the fourth side 42 are sewn similarly to the second side 38 (and the corner between the second side 38 and the third side 40) discussed above.

Figure 11:
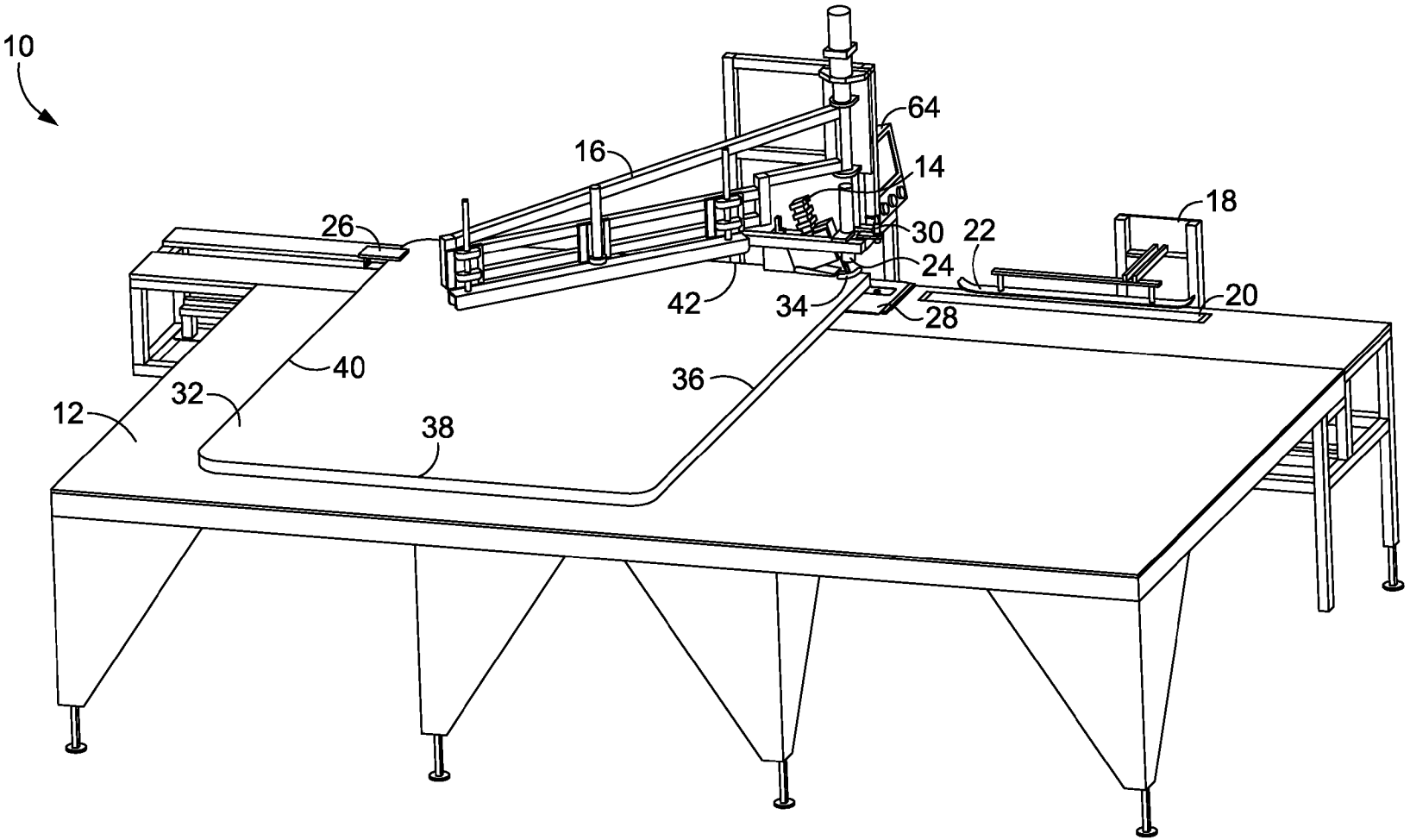

Referring next to FIG. 11, the machine 10 has completed sewing the fourth side 42. As discussed above, the sewing head 14 is determined to have completed sewing the fourth side 42 when the known distance (where the fourth side 42 is clamped by the material guide and encoding arm 26) added to the measured distance sewn (as measured by the material guide and encoding arm 26 during sewing of the fourth side 42) equals the programmed length (a pre-determined number programmed into the operator interface 64) minus the corner radius (the corner radius sewn at each corner when turning the work panel 90 degrees relative from one side of the work panel to the next).

Figure 12:
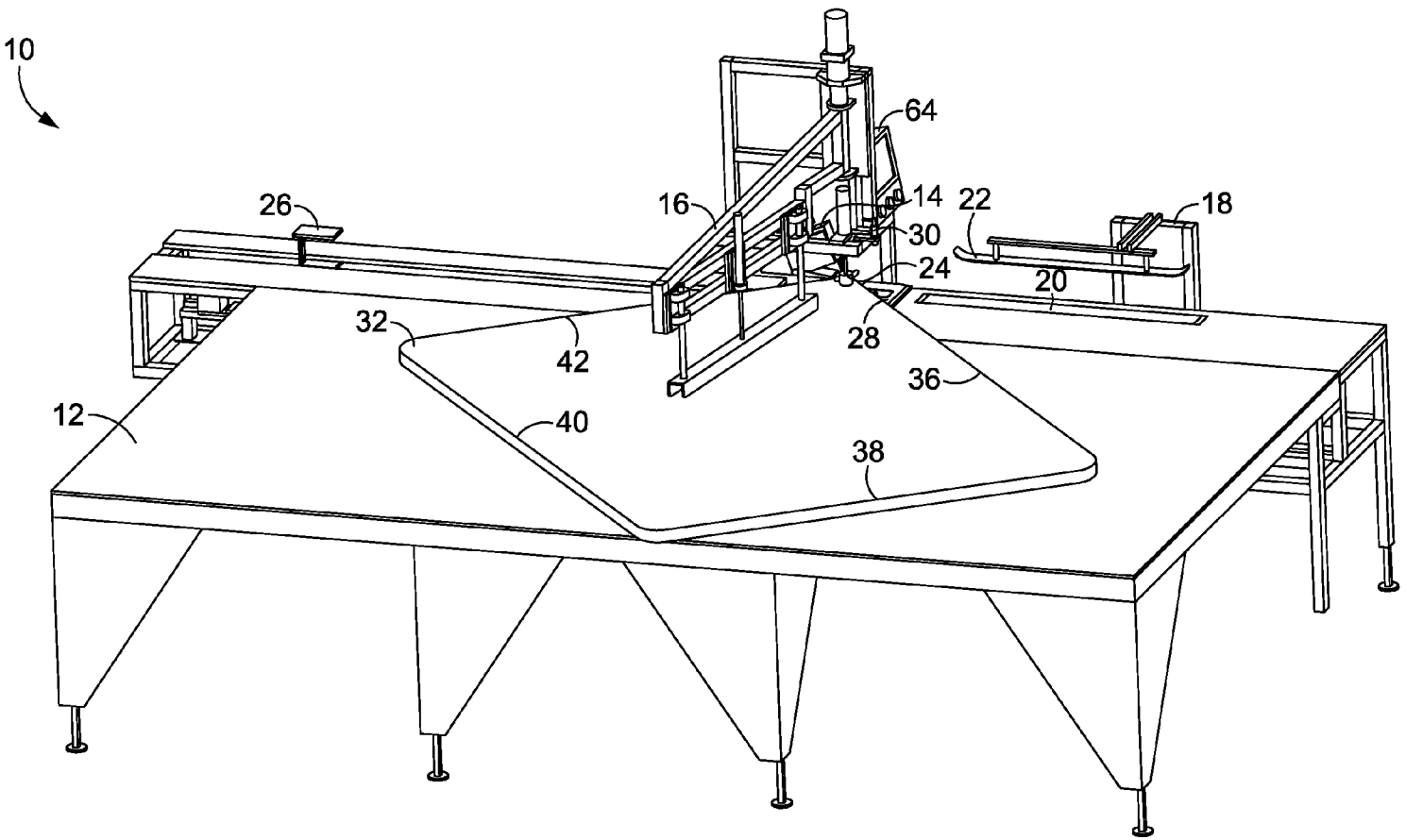
Figure 13:
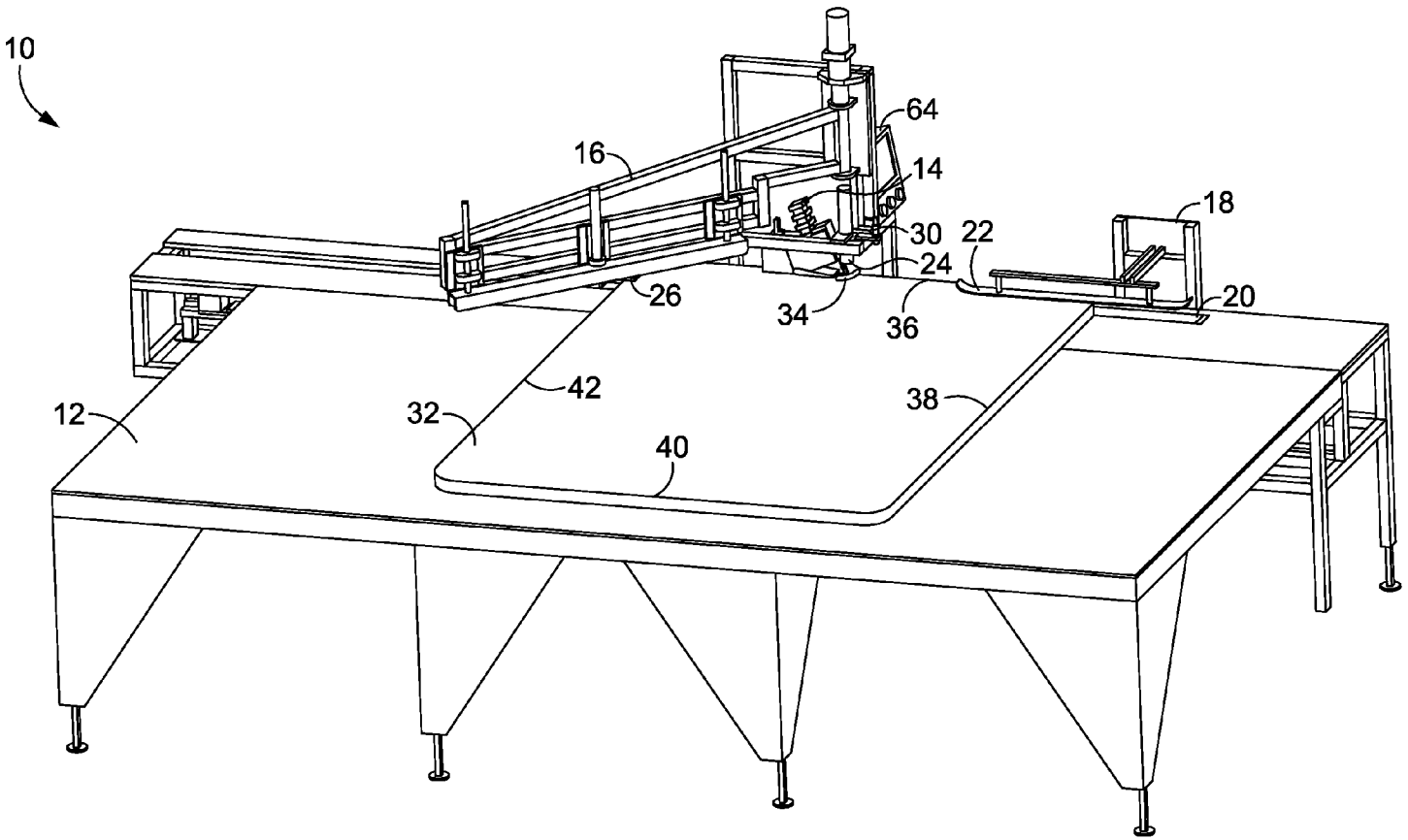
Figure 14:
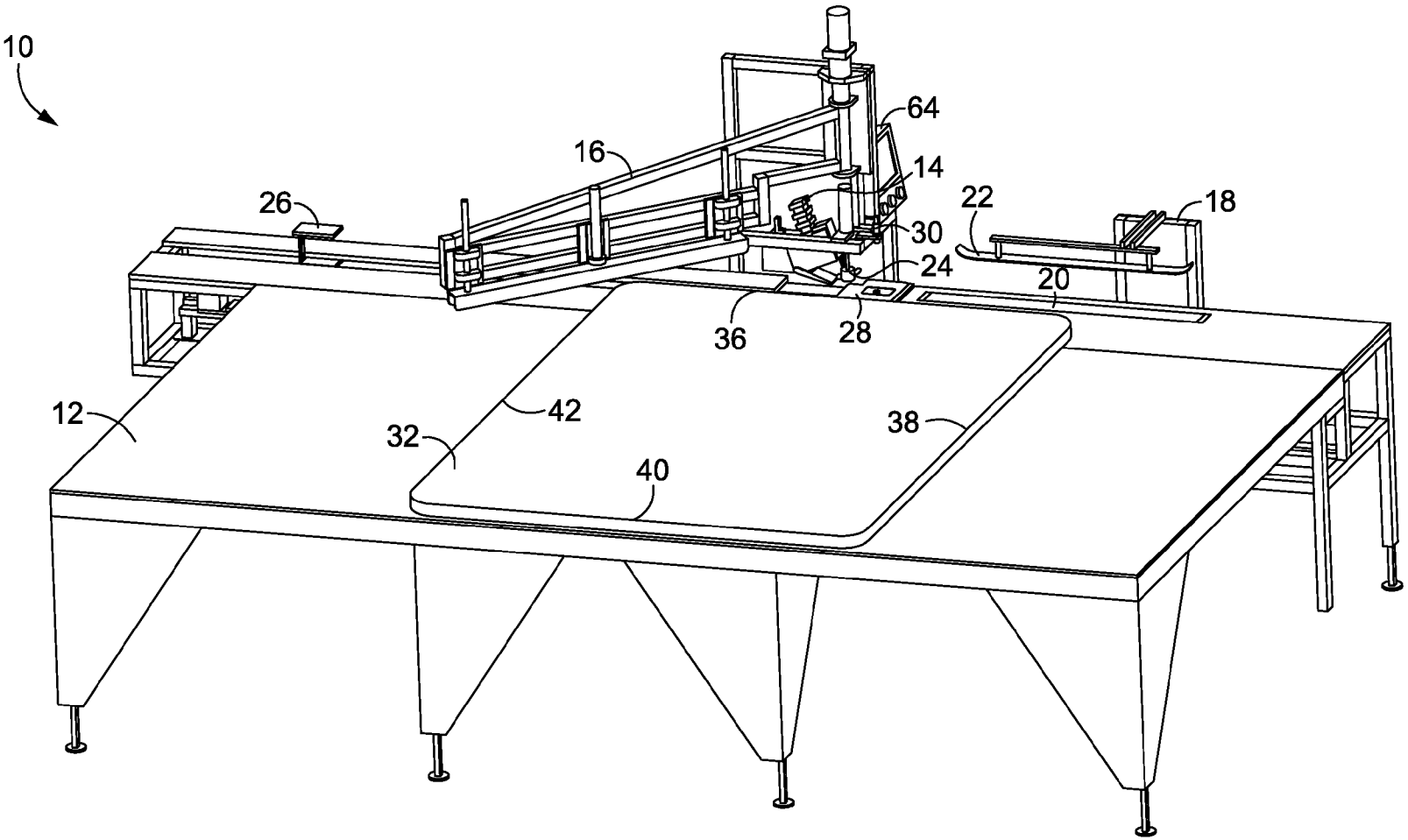

As shown in FIG. 12, the corner radius between the fourth side 42 and the first side 36 is sewn while the work panel 32 is turned. As previously discussed, the material guide and encoding arm 26 and the rear conveyor 18 are disengaged during turning and sewing of the corner, while the corner pivot mechanism 24 and the turning arm 16 are engaged against the work panel 32. In FIG. 13, having turned the work panel 32 so that the first side 36 is again aligned with the sewing head 14, the operator sews at least a portion of the first side 36, to the point where sewing began along the first side 36. As the end sewing line sewn by the sewing head 14 approaches the beginning sewing line sewn by the sewing head 14, the operator actuates the flange knife assembly 28 by selecting an option from the operator interface 64, as shown in FIG. 14. The flange knife assembly 28 actuates to cut off the flange, and the finished work panel 32 may be sewn off. As previously discussed, in some embodiments, the machine 10 sews the straight edges and consistent corners of the work panel 32 without attaching a flange to the bottom side of the work panel 32.

Figure 15:
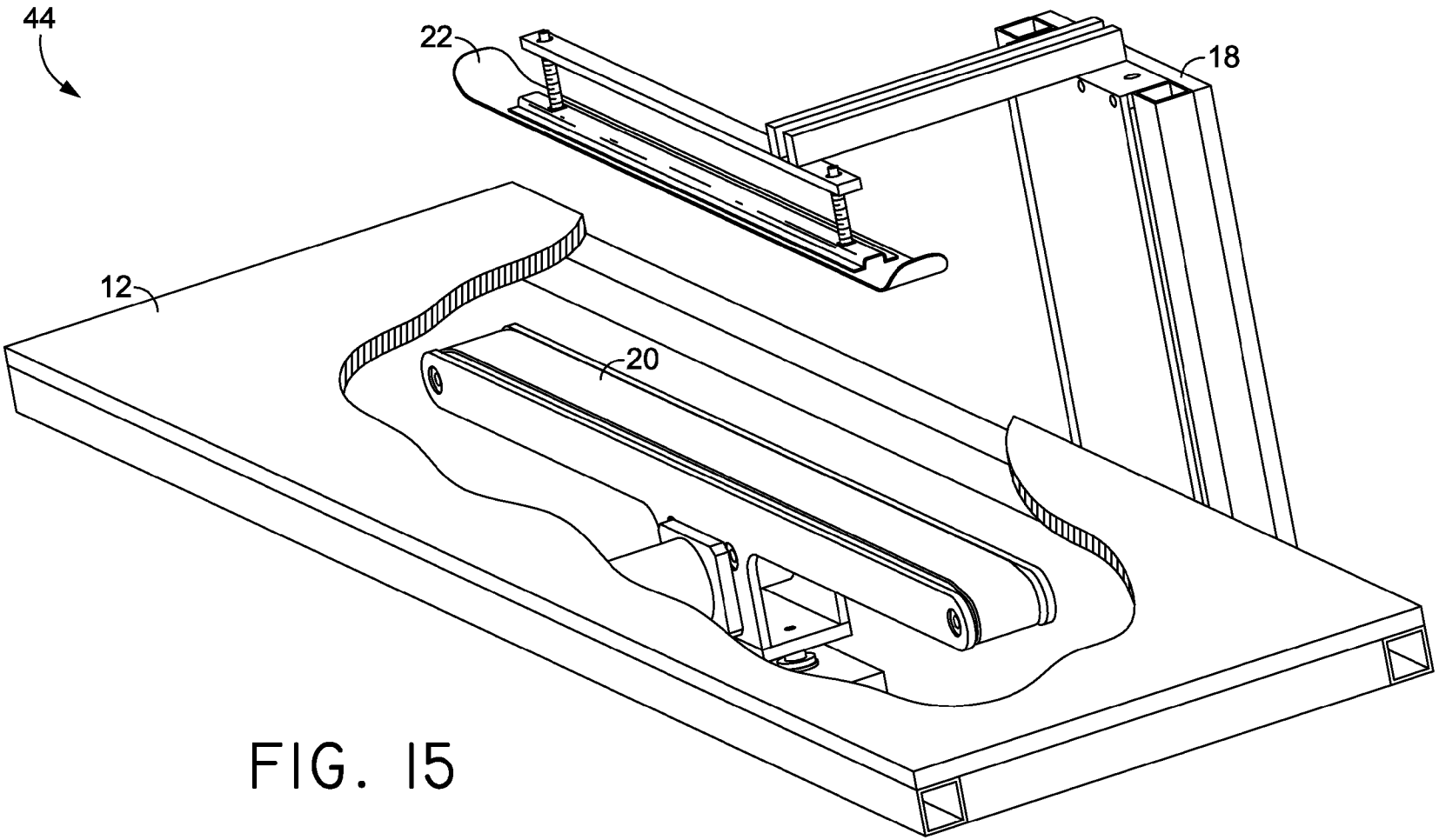
FIG. 15 is an enlarged, perspective view of the rear conveyor of the machine of FIG. 1.

Turning next to FIG. 15, an enlarged view 44 of the rear conveyor 18 is shown. As depicted in the cut-away portion of the table surface 12, the rear conveyor 18 includes a conveyor belt 20 which engages against the bottom surface of a work panel 32. Further, the conveyor pressure skid 22 may be lowered into contact with a work panel 32. As previously discussed, engaging both the conveyor belt 20 and the conveyor pressure skid 22 of the rear conveyor 18 enables the work panel 32 to be advanced during sewing by the machine 10. In some embodiments, because of the pressure applied by the components of the rear conveyor 18, the work panel 32 is fed at a consistent rate through the machine 10, and the sides of the work panel 32 are sewn in a straight line by the sewing head 14.

Figure 16:
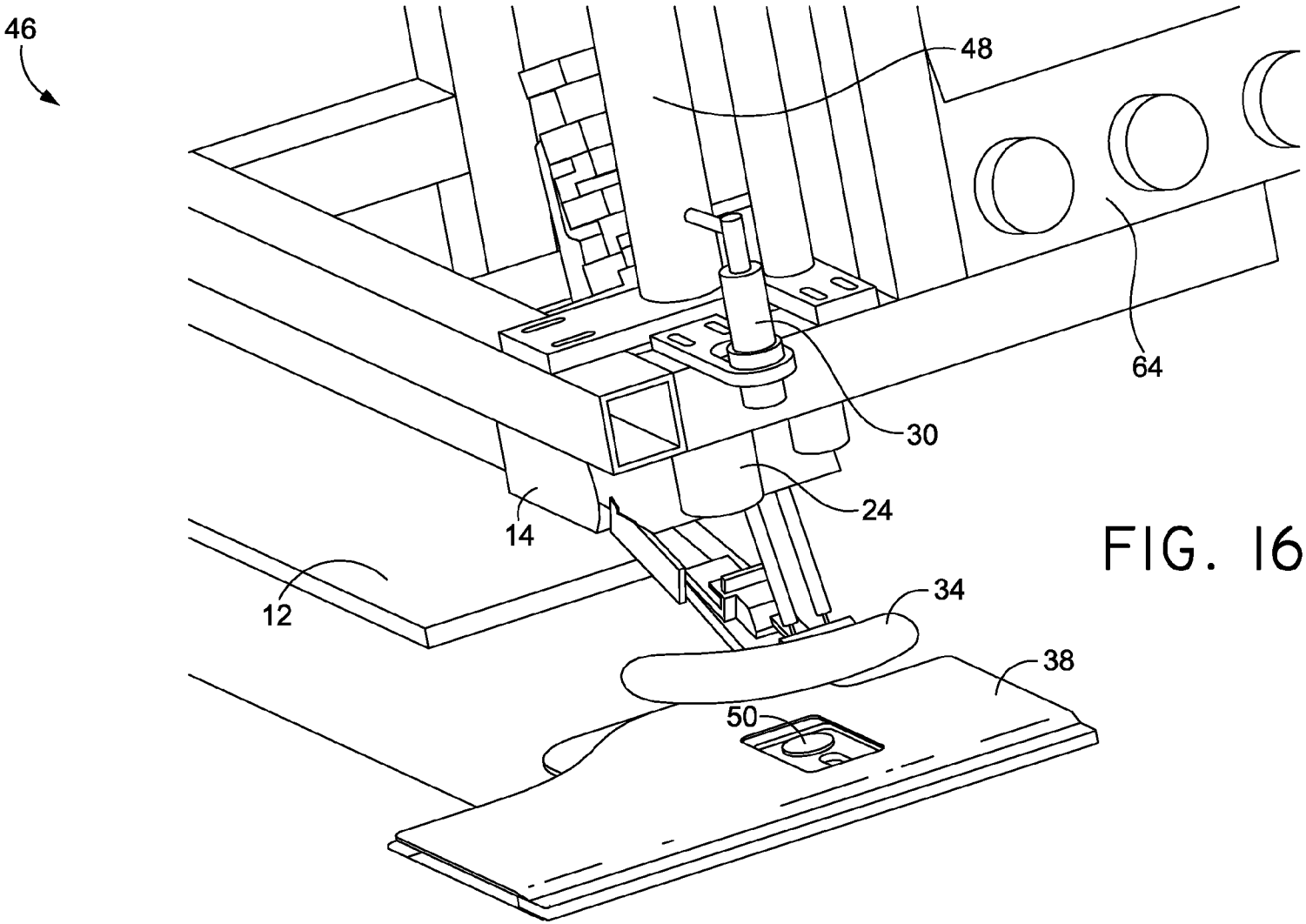
FIG. 16 is an enlarged, perspective view of the sewing area of the machine of FIG. 1.

With reference to FIG. 16, an enlarged view of the sewing area 46 is shown. The sewing area 46 includes the sewing head 14 and the presser foot 34, which are used to sew the straight edges of the work panel 32. Also viewed in the enlarged sewing area 46 are the corner pivot mechanism 24, the pivot cylinder 48, the trailing edge sensor 30, the trailing edge reflector 50, and the flange knife assembly 28. In embodiments, the pivot cylinder 48 actuates the pivot mechanism 24 so that the pivot mechanism 24 is engaged against the work panel 32 during turning. The trailing edge sensor 30, together with the trailing edge reflector 50, detects the trailing edge of the work panel 32 during sewing, as discussed above with reference to sewing the initial portion of the first side 36. In embodiments, the trailing edge sensor 30 is used to detect when the sewing head 14 has completed sewing at least a portion of the first side 36, and also to determine when the machine 10 is ready to turn the work panel 32 for sewing the corner radius between the first side 36 and the second side 38. When sewing subsequent sides of the work panel 32, such as the second side 38, third side 40, and fourth side 42, the material guide and encoding arm 26 is used to determine when to turn the work panel 32 and sew the corner radius, as opposed to using the trailing edge sensor 30.

Figure 17:
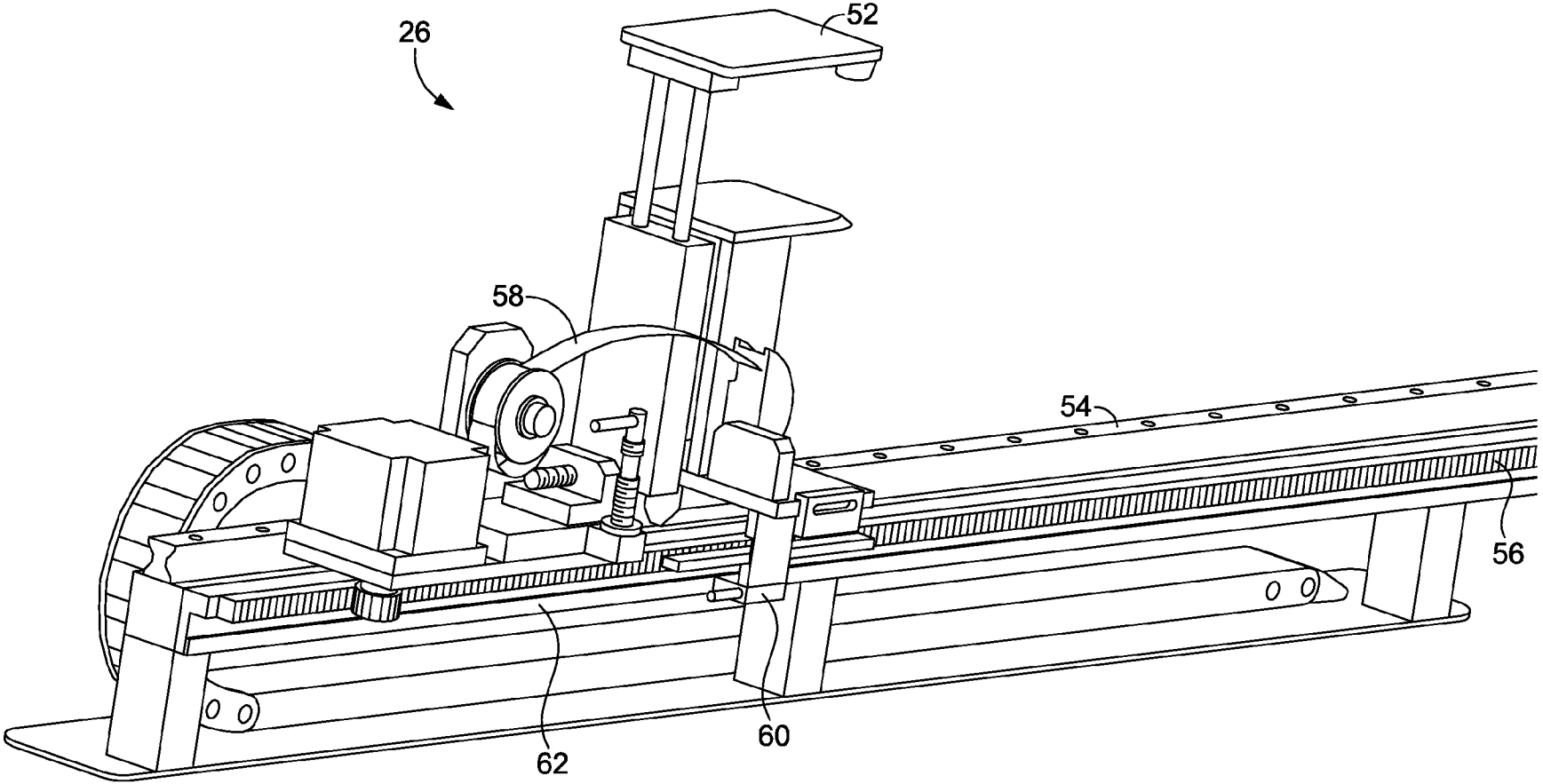
FIG. 17 is an enlarged, perspective view of the material guide and encoding arm of the machine of FIG. 1.

Turning last to FIG. 17, the material guide and encoding arm 26 is shown in an enlarged view. The material guide and encoding arm 26 includes a clamp 52, a linear guide 54, a gear rack 56, a constant force spring 58, an encoder 60, and a magnetic strip 62. As previously discussed, the clamp 52 of the material guide and encoding arm 26 is able to engage against the edge of the work panel 32 to measure the progression of the work panel 32 as a straight side is sewn by the sewing head 14. Such measurement is conducted using the encoder 60, which may be a linear encoder or another form of measuring device. The constant force spring 58 allows the material guide and encoding arm 26 to follow the edge of the work panel 32 as it is advanced by the sewing head 14 and sewn by the machine 10. As will be understood, in following the edge of the work panel 32, the material guide and encoding arm 26 does not apply pulling force to the work panel 32. Instead, the material guide and encoding arm 26 measures the progression of the work panel 32 as it is advanced by the sewing head 14 and the rear conveyor 18.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. An automated flanging machine, comprising:

a table adapted to support a work panel, wherein at least a portion of a bottom surface of the work panel is in contact with at least a portion of a top surface of the table;

a sewing head mounted directly adjacent to the table, the sewing head for performing a sewing operation on the work panel;

at least one turning arm mounted adjacent to the table, adapted to selectively turn the work panel on the table; and a rear conveyor mounted adjacent to the table, the rear conveyor comprising a conveyor belt and a conveyor pressure skid, wherein the rear conveyor is adapted to selectively move the work panel on the table, wherein the conveyor belt is adapted to engage against at least a portion of the bottom surface of the work panel, and further wherein the conveyor pressure skid is adapted to engage against at least a portion of a top surface of the work panel.

2. The machine of claim 1, further comprising:

a corner pivot mechanism mounted adjacent to the table, adapted to stabilize the work panel while the at least one turning arm turns the work panel.

3. The machine of claim 1, further comprising:

a material guide and encoding arm mounted adjacent to the table, adapted to measure a distance sewn by the sewing head.

4. The machine of claim 3, wherein the material guide and encoding arm comprises a linear encoder.

5. The machine of claim 1, further comprising:

a flange knife assembly mounted adjacent to the table, adapted to cut a flange after completing sewing the work panel.

6. The machine of claim 1, further comprising:

an operator interface mounted adjacent to the table, adapted to receive information related to the work panel being sewn by the automated flanging machine.

7. The machine of claim 1, further comprising a foot pedal associated with the sewing head, the foot pedal adapted to control a presser foot of the sewing head.

8. The machine of claim 1, further comprising a sensor, adapted to sense a trailing edge of the work panel as it approaches the sewing head.

9. A method performed by an automated flanging machine for automatically sewing a flange onto a work panel, the method comprising:

receiving a work panel onto a table in a first position, wherein in the first position a first side of the work panel is positioned adjacent to a sewing head, the sewing head mounted directly adjacent to the table;

sewing a flange onto the first side of the work panel, wherein a rear conveyor mounted adjacent to the table is in contact with the work panel during sewing;

using a sensor, determining that at least a portion of the first side is sewn;

using a turning arm, pivoting the work panel into a second position 90 degrees relative to the first position, wherein in the second position a second side of the work panel is positioned adjacent to the sewing head, further wherein the rear conveyor is not in contact with the work panel during pivoting;

sewing a corner radius during pivoting the work panel into the second position;

sewing the flange onto the second side of the work panel, wherein the rear conveyor is in contact with the work panel prior to beginning sewing the flange onto the second side;

using a material guide and encoding arm adjacent to the table, determining that the second side of the work panel is sewn;

using the turning arm, pivoting the work panel into a third position 90 degrees relative to the second position, wherein in the third position a third side of the work panel is positioned adjacent to the sewing head, further wherein the rear conveyor is not in contact with the work panel during pivoting;

sewing a corner radius during pivoting the work panel into the third position;

sewing the flange onto the third side of the work panel, wherein the rear conveyor is in contact with the work panel prior to beginning sewing the flange onto the third side;

using the material guide and encoding arm, determining that the third side of the work panel is sewn;

using the turning arm, pivoting the work panel into a fourth position 90 degrees relative to the third position, wherein in the fourth position a fourth side of the work panel is positioned adjacent to the sewing head, further wherein the rear conveyor is not in contact with the work panel during pivoting;

sewing a corner radius during pivoting the work panel into the fourth position; and sewing the flange onto the fourth side of the work panel, wherein the rear conveyor is in contact with the work panel prior to beginning sewing the flange onto the fourth side, wherein the rear conveyor comprises a conveyor pressure skid and a conveyor belt, and further wherein the conveyor pressure skid is adapted to engage the work panel in contact with the conveyor belt.

10. The method of claim 9, wherein the method further comprises using a corner pivot mechanism, wherein the corner pivot mechanism is in contact with the work panel during pivoting of the work panel.

11. The method of claim 10, wherein the corner pivot mechanism maintains a constant distance between the sewing head and the work panel during pivoting.

12. The method of claim 9, wherein using the material guide and encoding arm comprises measuring a distance sewn with a linear encoder as the work panel is sewn by the sewing head.

13. The method of claim 9, wherein the method further comprises:

using a flange knife assembly adjacent to the table to disconnect the work panel from the table after completing sewing the flange onto the work panel.

14. The method of claim 9, wherein the method further comprises:

using an operator interface coupled to the automated flanging machine to receive information related to the work panel being sewn by the automated flanging machine.

15. An automated flanging machine, comprising:

a table adapted to support a work panel;

a sewing head mounted directly adjacent to the table, the sewing head for performing a sewing operation on the work panel;

a turning arm mounted adjacent to the table, adapted to selectively turn the work panel on the table;

a corner pivot mechanism mounted directly adjacent to the table, the corner pivot mechanism adapted to secure the work panel while the turning arm turns the work panel on the table and the sewing head sews a corner radius on the work panel;

a rear conveyor mounted adjacent to the table, wherein the rear conveyor comprises a conveyor belt and a conveyor pressure skid, the conveyor pressure skid adapted to engage the work panel in contact with the conveyor belt;

a material guide and encoding arm adapted to measure a distance sewn as the work panel is sewn by the sewing head; and a sensor adapted to sense a trailing edge of the work panel as it approaches the sewing head, wherein the machine is adapted to perform the sewing operation along a first, second, third, and fourth side of the work panel, wherein the sewing operation is performed along the first side of the work panel using the sensor, and further wherein the sewing operation is performed along the second, third, and fourth sides of the work panel using the material guide and encoding arm, wherein the sewing operation comprises one or more of sewing straight edges along the first, second, third, and fourth sides of the work panel, and sewing corners of the work panel with a consistent corner radius.

16. The machine of claim 15, further comprising:

a flange knife assembly adjacent to the table, adapted to disconnect a flange from the table after completing sewing the flange onto the work panel.

17. The machine of claim 15, further comprising:

an operator interface mounted adjacent to the table, the operator interface configured to receive information related to the work panel being sewn by the automated flanging machine.

18. The machine of claim 15, further comprising:

a foot pedal associated with the sewing head, the foot pedal adapted to control a presser foot of the sewing head.

* * * * *